US006678925B1

(12) United States Patent
Howell

(10) Patent No.: US 6,678,925 B1
(45) Date of Patent: Jan. 20, 2004

(54) TWO-PIECE BUCKLE ASSEMBLY

(75) Inventor: Frank A. Howell, Oxford, ME (US)

(73) Assignee: DownEast, Inc., Bridgton, ME (US)

( * ) Notice: Subject to any disclaimer, the term of this patent is extended or adjusted under 35 U.S.C. 154(b) by 0 days.

(21) Appl. No.: 10/189,367

(22) Filed: Jun. 2, 2002

(51) Int. Cl.[7] ..... A44B 11/25
(52) U.S. Cl. ..... 24/647; 24/665
(58) Field of Search ..... 24/200, 647, 650, 24/643, 664, 665

(56) References Cited

U.S. PATENT DOCUMENTS

| | | | | |
|---|---|---|---|---|
| 1,397,237 A | * | 11/1921 | Schenk | 24/648 |
| 2,933,795 A | * | 4/1960 | Meeker | 24/647 |
| 3,214,815 A | * | 11/1965 | Mathison | 24/200 |
| 5,187,843 A | * | 2/1993 | Lynch | 24/587.12 |
| 5,243,741 A | * | 9/1993 | Fudaki et al. | 24/200 |
| 5,832,573 A | | 11/1998 | Howell | 26/664 |
| 6,076,237 A | * | 6/2000 | Goorhouse | 24/200 |
| 6,154,936 A | | 12/2000 | Howell et al. | 24/625 |

FOREIGN PATENT DOCUMENTS

JP 6-038809 A * 2/1994

* cited by examiner

*Primary Examiner*—James R. Brittain
(74) *Attorney, Agent, or Firm*—Samuels, Gauthier & Stevens

(57) ABSTRACT

A two-piece lanyard release buckle having first and second ends which are adapted to receive straps. A keeper has a floor which includes front and rear portions and a first end formed in the rear portion thereof. A flexible cover is spaced apart from the floor, such that the opposed surfaces of the floor and cover define a slot therebetween. A keeper surface is formed on either of the opposed surfaces. The buckle includes side walls spaced apart from one another and which are perpendicular to the cover and floor. The cover and the floor are flexibly secured to one another and a lanyard is secured to the cover. A secure part configured to be received in the slot has a front portion and a rear portion. The secure part has at least one locking surface, wherein the keeper surface and the locking surface are at mirror imaged angles with reference to one another.

8 Claims, 4 Drawing Sheets

TWO-PIECE BUCKLE ASSEMBLY

BACKGROUND OF THE INVENTION

1. Field of the Invention

The invention relates to quick release buckles for backpacks and the like.

2. Description of the Relevant Art

Web straps on light weight backpacks, rucksacks and hiking packs typically use "side-action" buckles to allow shoulder, compression and/or large pocket straps to be parted. This side-action buckle design has significant limitations when used in this capacity. The release tabs are recessed onto the sides of the buckle so they can be difficult to find and release when hurried or when wearing winter gloves. Both release tabs must be squeezed simultaneously toward each other to part the buckle. The hand force required to push the halves together and lock them cannot be increased/decreased without a proportional impact on the hand force required to unlock them. When separated, the exposed locking tabs of the male-half (tongue) of the buckle can be easily broken off and the female-half (body) can be crushed if stepped on. U.S. Pat. No. 6,154,936 overcame many of these problems.

The present invention is directed to a buckle for use with load bearing webbing, e.g. for backpacks, such as used in the military and is an improvement of the '936 patent.

SUMMARY OF THE INVENTION

The present invention is an improvement to the buckles described in the '963 patent, the disclosure of which is hereby incorporated by reference in its entirety into this disclosure, and embodies an inexpensive, two-piece buckle that can be conveniently opened even while hurried or wearing winter gloves. The buckle can be opened with the natural, intuitive upward pulling action. The forces required to lock and release the buckle are independently controlled. The buckle is durable even when the two interlocking halves are separated.

Broadly the invention, in one embodiment, comprises a two-piece lanyard release buckle including a keeper and a secure. The keeper has a floor which includes a front portion and a rear portion. A cover is spaced apart from the floor, the opposed surfaces of the floor and cover defining a slot therebetween. A keeper surface is formed on one of the opposed surfaces of either of the floor or the cover. The floor and cover are flexibly secured one to the other. A lanyard is secured to the cover.

The secure is configured to be received in the slot. The secure has a front portion and a rear portion. The secure is characterized by at least one locking stepped surface transversing the secure whereby as the secure is received in the keeper, the secure travels along a first axis, the stepped surface engages the keeper surface and locks the secure to the keeper. The keeper surface and the locking surface are mirror imaged sloped to prevent unexpected release when the buckle is under load.

When the buckle is unlocked the lanyard is pulled upwardly. The keeper surface travels along a second axis distinct from the first axis to release the keeper surface from the locking surface thereby unlocking the buckle.

In one embodiment of the invention, the secure is designed to keep the keeper slot free of debris; snow, ice and dirt. The front portion of the keeper has a leading edge, an upper surface and a lower surface. A recess is formed in the lower surface and extends inwardly from the leading edge. Crenellations are formed in the recess at the leading edge. The movement of the secure into and out of the slot of the keeper pulls the debris out of the slot.

In another embodiment of the invention, a strap locking system is formed either at the rear portion of the keeper and/or secure. At the rear portions of either or both the keeper and the secure are slots in which slots are formed saddles. Straps which secure the keeper and secure pass through and over (are looped around) the saddle. Usually one strap is stitched (fixed) in place and the other end is adjustable. To adjust the strap, the secure is angled, the pinch pressure is reduced, the strap can slip over the saddle until the desired length is reached and the secure is released and the pinch restored. With a lanyard buckle, pulling the lanyard typically rotates the buckle. This movement inherently tends to slip the strap. In this embodiment, teeth angled at 45° are formed in the saddle. When the lanyard is pulled as the buckle turns, the teeth rotate and seat into the strap preventing any movement. After the teeth seat and the buckle returns to its normal position it is subjected to intermittent loads during normal use.

With prior art buckles, these intermittent loads cause the adjustable strap to slip or loosen and the strap must be continually adjusted. With the present invention, the teeth prevent this slippage.

In the preferred embodiment of the invention, all just described embodiments are combined.

DESCRIPTION OF THE PREFERRED EMBODIMENT(S)

Figure 1:
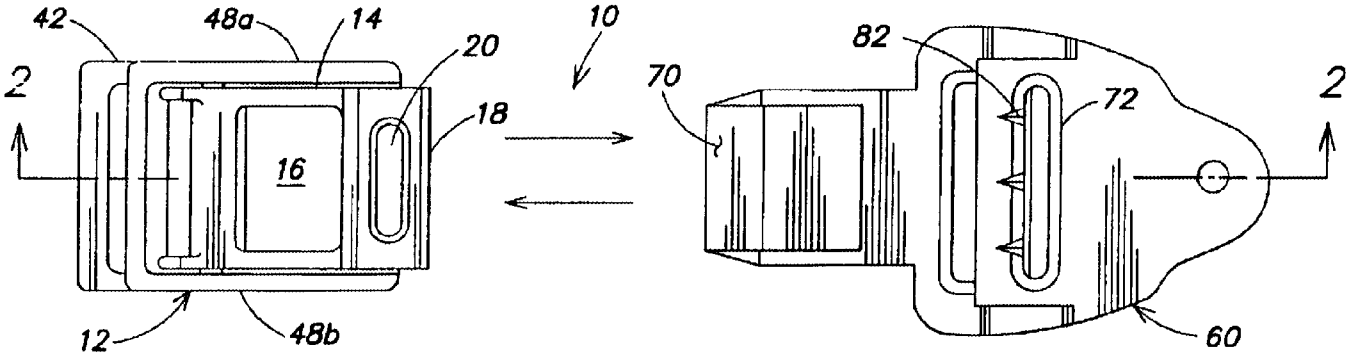
FIG. 1 is a top view of a keeper and a secure.
Figure 2:
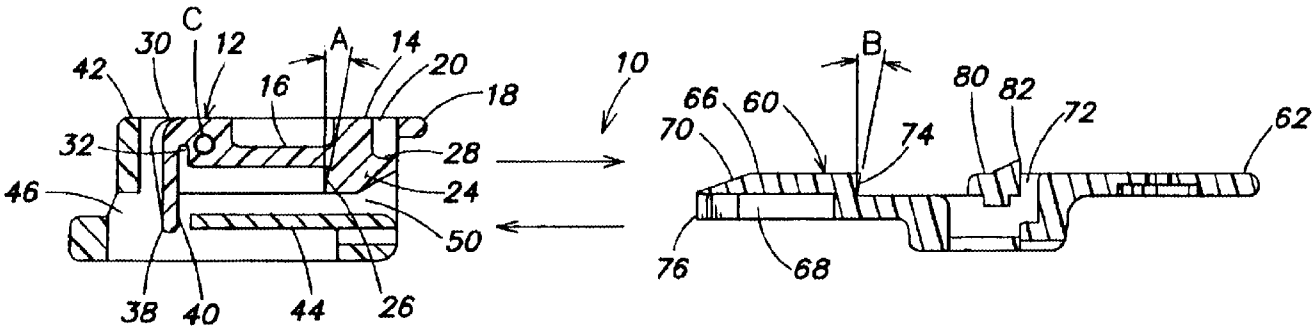
FIG. 2 is a sectional view taken along line 2—2 of FIG. 1.

Referring to FIGS. 1 and 2. a quick release buckle assembly is shown generally at 10 and comprises a keeper 12 and a secure 60. The keeper 12 includes a cover 14 pivotally secured to a body 42 at C.

The cover 14 comprises a top 16 and has a leading edge 18. The leading edge 18 is characterized by a slot 20 through which a lanyard 50 is secured.

Referring to FIG. 2, the leading edge 18 also comprises a depending detent 24 having an angled keeper surface 26. The surface 26 is sloped between 5 to 25°. The detent 24 is recessed at 28 to allow clearance for attaching the lanyard. The cover 14 further comprises a trailing edge 30 characterized by a recess 32. The trailing edge 30 has a flexible, depending tail piece 38 having a drive surface 40.

The body 42 of the keeper 12 has a base (floor) 44 and a slot 46 formed therein through which a strap (not shown) is secured. The slot 46 also allows free movement of the tail piece 30 in the body 42. The body comprises opposed walls 48*a* and 48*b* which are mirror images of one another. The floor 44 in combination with the cover 14 defines a slot 50.

Figure 7:
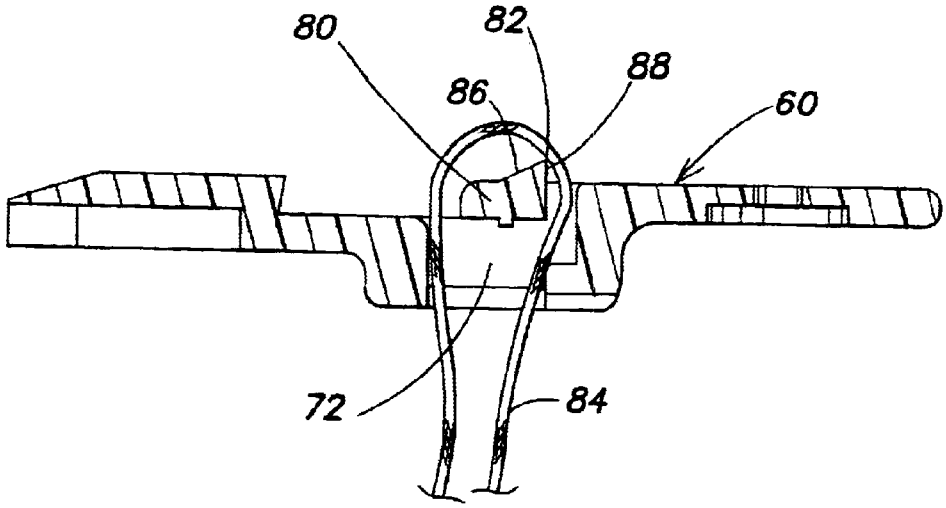
FIG. 7 is a sectional view of the secure showing the strap in a relaxed position.
Figure 8:
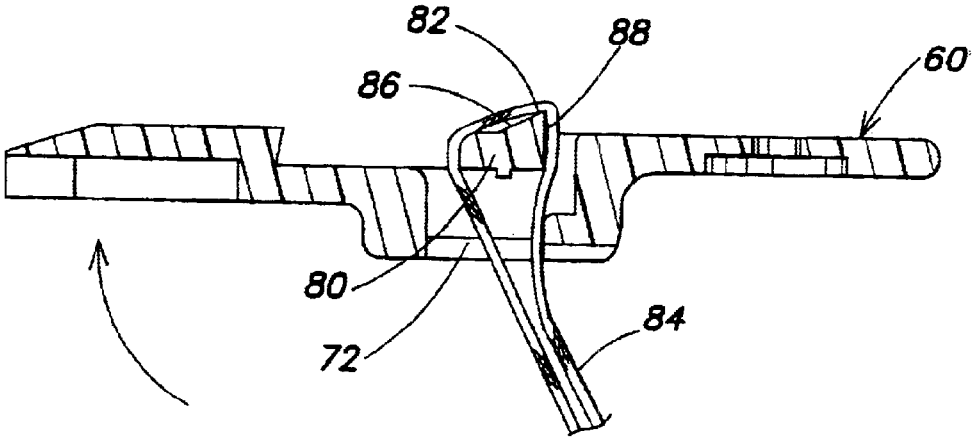
FIG. 8 is a sectional view of the secure showing the teeth gripping the strap to prevent movement of the strap.

The secure 60 of the buckle assembly 10 comprises a rear section 62 having a slot 72 for the attachment of an adjustable strap, see FIGS. 7 and 8. The secure part 60 comprises a forward tongue section 66 comprising a recess 68 and an upper chambered surface 70. On the underside of the section 66 at the leading edge are crenellations 76. The rear wall of the section 66 comprises a locking surface 74 which is angled to between 5 to 250°.

Referring to FIGS. 1 and 2, in the operation of the invention, the chambered surface 70 of the section 66 engages the detent 24. As the secure 60 continues to move into the slot 50 of the keeper 12, the cover 14 first rotates about point C. Continued insertion pressure on the secure 60 results in the leading edge of the section 66 engaging the drive surface 40 and flexing the tailpiece 38 until the keeper surface 26 and the locking surface 74 align, snap past each other, engage one another and then they are positively joined in locking engagement. The surfaces 26 and 70 are mirror image angled one to the other.

Figure 3:
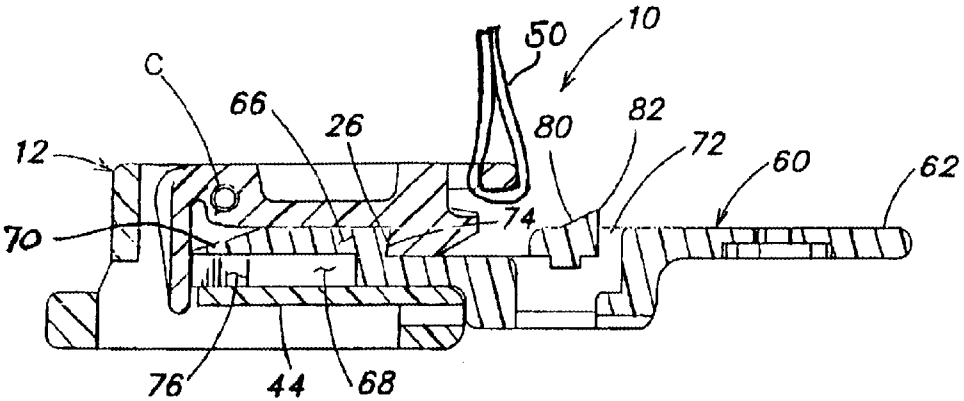
FIG. 3 is a sectional view taken along line 2—2 of FIG. 1.

In the closed position. FIG. 3, the capture surfaces 26 and 72 contact on the sloped surfaces that draw them together as the buckle assembly is placed under load. Further, the leading edge of the section 66 positively engages the tail piece 38 of the cover 14. Whether or not placed under load, this the pre-loaded release spring feature of the flex latch keeps the buckle assembly tightly closed.

The buckle assembly is designed to prevent inadvertent or unintentional opening. To release the secure 60 from the keeper 12. when the release lanyard is pulled upwardly, the flex allows the keeper and locking surfaces 26 and 72 to disengage and release. The lanyard must be pulled along a trajectory which lies in a plane which is substantially perpendicular to the axis of rotation of the latch. The latch is free to rotate around the pivot point C and separate the secure part 60 from the keeper part 12 by driving its tail piece 38 against the leading end of the section 66. To ensure an unloaded fail safe release, the secure 60 is levered by the detent 24 past the point that the surfaces 26 and 76 will align. It should be noted that for the capture surfaces to disengage, the flex area must flex and thereby store energy. After the capture surfaces clear, at least a portion of the stored energy transfers to the detent 38 to drive the same. This energy or force is in addition to the release force generated by pulling the lanyard.

Figure 4:
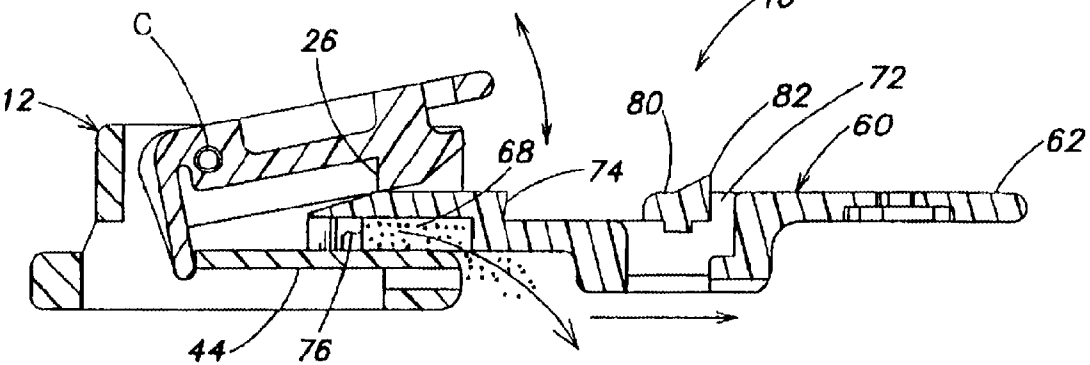
FIG. 4 is a sectional view taken along line 2—2 of FIG. 1.
Figure 5:
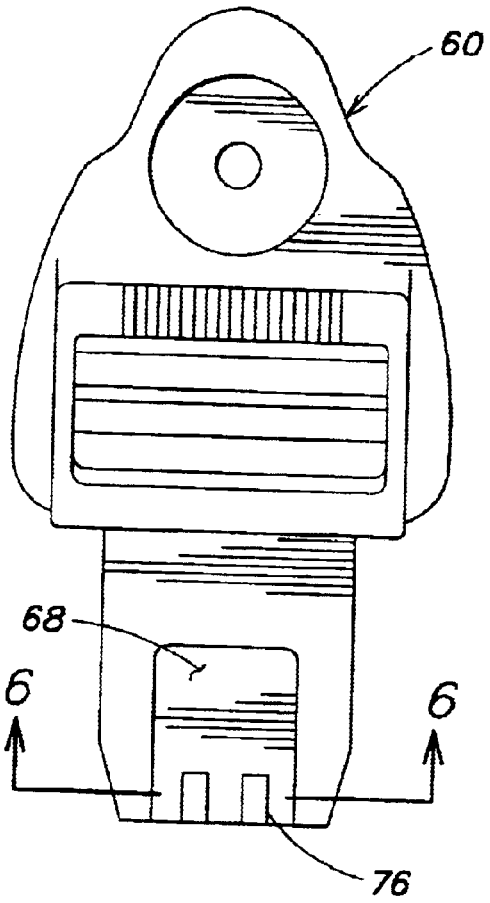
FIG. 5 is a bottom view of the secure showing the relative position of teeth used for securing a strap and crenellations used in debris removal.
Figure 6:
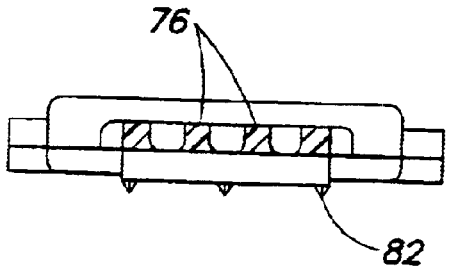
FIG. 6 is a sectional view taken along line 6—6 of FIG. 5.

Referring to FIGS. 3, 4 and 5, the underside of the section 66 is characterized by the recess 68 and the crenellations 76 at the leading edge. The crenellations 76, when the secure 60 is withdrawn, carry with them debris, which debris is ejected from the keeper 10 as illustrated in FIG. 4.

Referring to FIGS. 7 and 8, received in the slot 72 is a saddle 80 having a plurality of pryimidal shaped teeth 82 extending therefrom. An adjustment strap 84 passes through (around) the saddle 80. When the lanyard is pulled to release the secure 60 from the keeper 12, the buckle 10 has a tendency to rotate upwardly as shown by the arrow in FIG. 8. The teeth 82, seat in the adjustment strap 84 and prevent unwanted displacement around the saddle 80 when the lanyard is pulled.

Also, whether or not the lanyard has been pulled, the teeth 82 will seat in the strap 84 during normal use where there is continual intermittent loads on the strap and prevent slippage normally incurred with buckles of this type.

Referring to FIGS. 7 and 8, the shape of the teeth 82 is important. The teeth 82 comprise two slopes 86 and 88. The slope 86, at an angle of about 45°, makes it easier to tighten the strap, while the slope 88, at an angle of about 90°, makes it harder to loosen the strap.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A two-piece lanyard release buckle which comprises:

the buckle having first and second ends which ends are adapted to receive straps;

a keeper having a floor which includes a front portion and a rear portion and the first end formed in the rear portion;

a flexible cover spaced apart from the floor, the opposed surfaces of the floor and cover defining a slot therebetween, a keeper surface formed on one of the opposed surfaces of either the floor or the cover;

side walls spaced apart from one another and perpendicular to the cover and floor;

means for flexibly securing the cover and the floor to one another;

a lanyard secured to the cover;

a secure part configured to be received in the slot, the secure part comprising a front portion and a rear portion, the second end formed in the rear portion the front portion of the secure part has an upper surface and a lower surface and a leading edge, a recess in the lower surface extending rearwardly from the leading edge and crenellations extending downwardly from the leading edge into the recess.

2. The buckle of claim 1 wherein the keeper surface is formed on the opposed surface of the cover.

3. The buckle of claim 1 which comprises: means for securing an adjustment strap to the buckle comprising a slot formed in at least the first or second end, a saddle secured in the slot, the saddle having pyrimidal shaped projections angled at about 45° with reference to the horizontal plane in which the buckle lies.

4. A two-piece lanyard release buckle which comprises:

the buckle having first and second ends which ends are adapted to receive straps;

a keeper having a floor which includes a front portion and a rear portion and the first end formed in the rear portion;

the front portion of the secure has an upper surface and a lower surface and a leading edge, a recess in the lower surface extending rearwardly from the leading edge and crenellations extending downwardly from the leading edge into the recess a flexible cover spaced apart from the floor, the opposed surfaces of the floor and cover defining a slot therebetween, a keeper surface formed on one of the opposed surfaces of either the floor or the cover;

side walls spaced apart from one another and perpendicular to the cover and floor;

means for flexibly securing the cover and the floor to one another;

a lanyard secured to the cover;

a secure part configured to be received in the slot, the secure part comprising a front portion and a rear portion, the second end formed in the rear portion, the secure part characterized by at least one locking surface, the keeper surface and the locking surface mirror imaged angled with reference to one another; and means for securing an adjustment strap to the buckle comprising a slot formed in at least one of the ends, a saddle secured in the slot the saddle having pyrimidal shaped projections angled at about 45° with reference to the horizontal plane in which the buckle lies.

5. The buckle of claim 4 wherein the keeper surface is formed on the opposed surface of the cover.

6. A two-piece lanyard release buckle which comprises:

the buckle having first and second ends which ends are adapted to receive straps;

a keeper having a floor which includes a front portion and a rear portion and the first end formed in the rear portion;

a flexible cover spaced apart from the floor, the opposed surfaces of the floor and cover defining a slot therebetween, a keeper surface formed on one of the opposed surfaces of either the floor or the cover;

side walls spaced apart from one another and perpendicular to the cover and floor;

means for flexibly securing the cover and the floor to one another;

a lanyard secured to the cover;

a secure part configured to be received in the slot, the secure part comprising a front portion and a rear portion, the second end formed in the rear portion, the secure part characterized by at least one locking surface, the keeper surface and the locking surface mirror imaged angled with reference to one another and wherein the front portion of the secure has an upper surface and a lower surface and a leading edge, a recess in the lower surface extending rearwardly from the leading edge and crenellations extending downwardly from the leading edge into the recess.

7. The buckle of claim 6 wherein the keeper surface is formed on the opposed surface of the cover.

8. The secure part of claim 1, comprising at least one locking surface, the keeper surface and the locking surface mirror imaged angled with reference to one another.

* * * * *